United States Patent [19]

Cohen

[11] 4,078,342

[45] Mar. 14, 1978

[54] SERIES OF ELEMENTS

[75] Inventor: Michël Ernst Cohen, Amsterdam, Netherlands

[73] Assignee: Cohen, Pesman, Zee, Ontwerp B.V., Netherlands

[21] Appl. No.: 759,979

[22] Filed: Jan. 17, 1977

Related U.S. Application Data

[63] Continuation of Ser. No. 632,499, Nov. 17, 1975, abandoned.

[30] Foreign Application Priority Data

Nov. 20, 1974 Netherlands ..... 7415158

[51] Int. Cl.[2] .....E04H 1/12

[52] U.S. Cl. .....52/79.1; 312/198

[58] Field of Search .....52/79.1; 46/23; 35/69, 35/72; 273/156, 157 R; 312/198, 107

[56] References Cited

FOREIGN PATENT DOCUMENTS 2,250,769 4/1974 Germany ..... 312/198

OTHER PUBLICATIONS

*Mathematical Models,* H. Cundy & A. Rollett, Oxford Univ. Press, 1961, pp. 68–71.

*Primary Examiner*—Ernest R. Purser
*Assistant Examiner*—Carl D. Friedman
*Attorney, Agent, or Firm*—Irving M. Weiner; Pamela S. Austin

[57] ABSTRACT

A plurality of elements with dimensions forming a series of the FIBONACCI-type having a relationship of $\frac{1}{2} \pm \frac{1}{2}\sqrt{5}$. Such elements are suitable for economizing storage space and manufacturing costs as only a limited number of different sizes are to be kept in stock.

10 Claims, 2 Drawing Figures

SERIES OF ELEMENTS

This is a continuation of application Ser. No. 632,499, filed on Nov. 17, 1975, now abandoned.

BACKGROUND OF THE INVENTION

My invention relates to a series of elements consisting of articles with a mutual relationship and dimensioned according to standard sizes, which starting from an initial value, constitute a sequence. Such a series of elements is e.g. used in the building industry where within the scope of the industrialisation it has been tried to realize a so-called modular coordination.

A problem which occurs with a modular normalization is the great extent of liberty in designing buildings or interiors which one wants to maintain in general. This trend towards a modular normalization has on paper been successful to a degree and an example thereof is the S.A.R. designing method. (S.A.R. is a Netherlands Foundation for Architectural Research).

On realizing this system it has been found in practice that the manufacturer must choose between the fabrication of a plurality of panel sizes for bridging differences in size which arise, or that a plurality of fitting pieces should be held in store. A further considerable drawback of the methods performed consists of the inevitable loss consisting of sawed off pieces which cannot be used in the existing sequence.

SUMMARY OF THE INVENTION

My invention aims to provide a series of elements corresponding with a range of sizes which per article can be selected on their functional grounds that is to say grounds of applicability. According to my invention the size of the elements constitutes a series of the FIBONACCI type with an interrelation of $\frac{1}{2} \pm \frac{1}{2}\sqrt{0.5}$.

From the arithmetical angle this "series" can also be considered as a progression since each size appears to have a value which is equal to the sum of the two preceding sizes.

As the interrelation of the sizes is approximately equal to $\frac{1}{2} \pm \frac{1}{2}\sqrt{5}$ not only the number of possibilities of combination increases, but also the interval between the terms decreases. The advantages of such a series of elements with respect to production lies in the fact that with a very limited number of sizes one has an almost unrestricted possibility of combination. As a consequence of the aforementioned summation ability the sawing- or cutting loss is reduced to a minimum, since each sawing- or cutting rest constitutes again a new smaller size of said same series, which size can be used again.

The series of elements according to my invention is particularly distinguished in that the starting value of the series is constituted by a standard size which has a particular plate in the series. This particular place may be a smallest or greatest applicable value but may also be constituted by an intermediate size of the series, whereby then a part of the series has a smaller value (factor $\frac{1}{2} - \frac{1}{2}\sqrt{5}$) and the other part consists of one or more greater sizes (factor $\frac{1}{2} + \frac{1}{2}\sqrt{5}$).

It should be noted that the selection of the starting size or the sizes from the series can be determined from different standpoints, for instance on the base of function, size of material, production method or transport. Obviously other considerations are also possible. This choice is made according to whether the practicableness or the profit earning ability of the project concerned is the most decisive factor. This results in that for a complete project one can start in designing already from a standard itemization per product, a standared production series or process or a functional approach of the size by a well founded selection of the sizes of the base series and the length thereof. It should be noted that evidently not always a complete series need be selected. Since all sizes due to the summation ability can be composed from each other there are no compelling reasons to produce all sizes.

My invention relates particularly to a series of elements used e.g. in arranging a kitchen. Such a use lends itself particularly for normalization and standardization. According to my invention the starting value of the series is constituted by a measure of length of 60.3 cm while the descending part of the series recedes to 5.4 cm, whereby only six standard sizes are required.

In such a system there is therefore a very limited number of parts required which also simplifies the storage problem. Every composite size can also be immediately supplied, since it consists of two or more preceding sizes. On elaborating this system it appears that not only when a higher starting value is used but also with the group of lower values, one obtains an interval between two series, which is smaller than the smallest selected size. This implicates directly a connection with the itemization of the product. E.g. one selects a size series for house front elements. Now a window frame itemization could be selected in the same series at a lower level.

SURVEY OF THE DRAWINGS

FIG. 1 is a perspective view of the interior of a kitchen;

DESCRIPTION OF PREFERRED EMBODIMENTS

Figure 7:
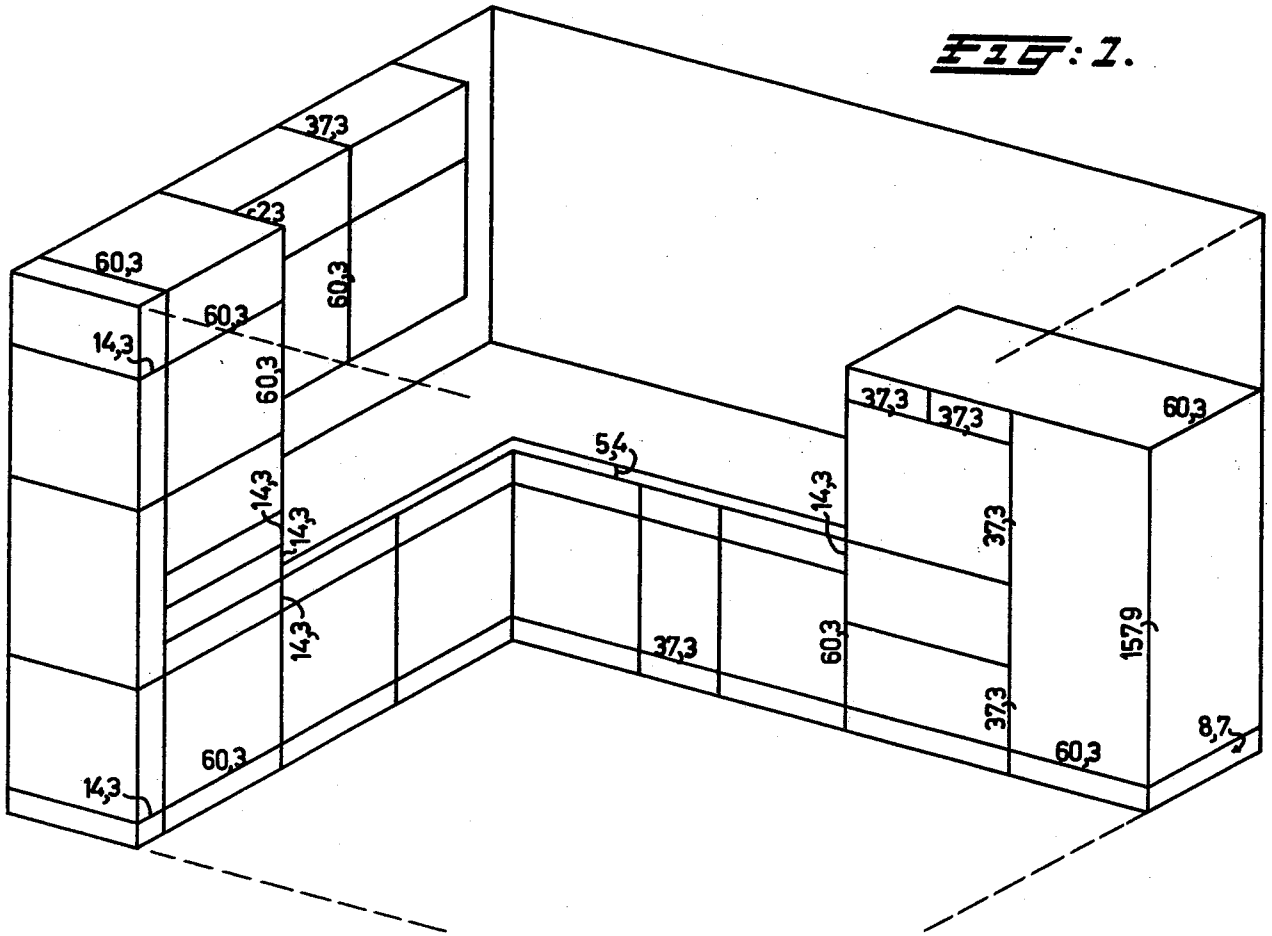

In designing a module system for arranging a kitchen the starting point may be a size in the value of 60.3 cm. The preceding value is obtained by multiplication with the factor $\frac{1}{2} - \frac{1}{2}\sqrt{5}$, that is to say the factor 0,618, so that the size 37.3 cm is obtained. Further descending the values 23.0, 14.3, 8.7 and 5.4 cm are obtained. These sizes can be considered as the basic dimensions for the arrangement of a kitchen.

When e.g. free space of slightly less than 60.3 cm is available, e.g. 55.2 cm, then this space can be filled with an element sized 37.3 cm in combination with an element of 14.3 cm, whereby then only a free space of 3.6 cm is left. If a space of 60.3 cm is indeed available then an element of this size can be disposed therein in conformity with the two preceding values of the series viz. an element of 37.3 cm (e.g. a chest of drawers) and an element of 23.0 (e.g. a towel drier).

The series of elements according to the invention can be used both in the vertical direction and in the horizontal plane. On ergonomic considerations there are particular fixed values like the height of the dresser, the space between the dresser and the boxes disposed over the dresser, the greatest heights of the boxes and the ceiling height. In the system according to my invention cabinets may be added in order to attain the desired dresser height. When there is a ground clearance or plinth of 10.3 cm and a dishwasher is installed then an element with the greatest value (60.3 cm) can be used with a chest with a drawer height of 14.3 cm disposed thereon, together with a thickness of the slab of the dresser of 5.4 cm, so that a total value of almost 90 cm, that is to say the most advantageous height is obtained.

From the underside of the dresser slab there is measured 60.3 cm in an upward direction in order to reach the underside of the boxes above the dresser. In this way it is possible to align these boxes correctly with the elements provided along the other walls of the kitchen.

Usually these hanging boxes consist of two boxes placed on one the other, the lower one having a height of 60.3 cm and the upper one having a height of 37.3 cm. The top level of these boxes then lies at about 240 cm which is an acceptable ceiling height for a kitchen. The series can progress in greater sizes by using the factor $\frac{1}{2} + \frac{1}{2}\sqrt{5}$. Starting from 60.3 cm one obtains then 97.6 and 157.9. The latter size is used for a cabinet from the interior according to FIG. 1.

Figure 2:
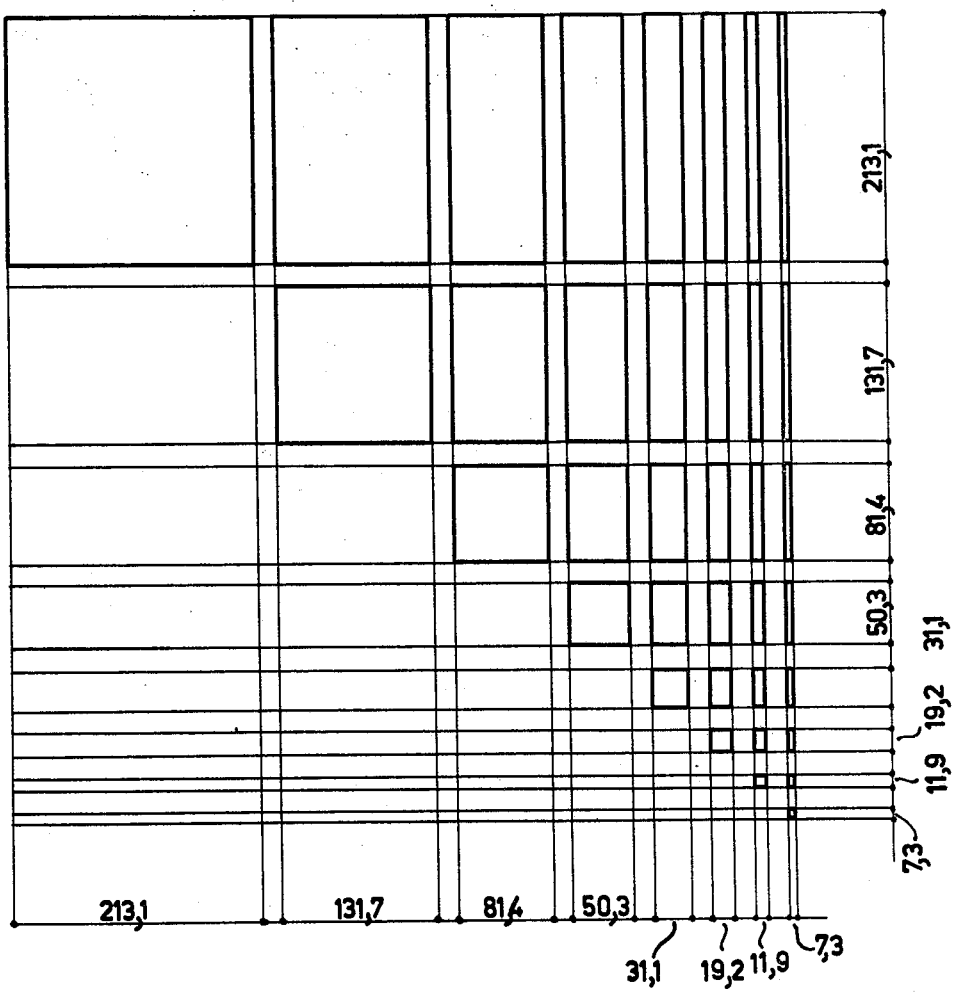
FIG. 2 illustrates a group of panels for an inner wall system to be manufactured.

My invention can likewise be applied to another field of technics and an example thereof is the inner wall panel system according to FIG. 2.

The sizes can be formed from a material the thickness of which constitutes the series size of 7.3 cm. This means for production- and/or panel sizes 7.3; 11.9; 19.2; 31.1; 50.3; 81.4; 131.7; and 213.1 cm. By incorporating the thickness of material into the series, the solutions for the corners are simplified. It is advisable to carry out the details in the smaller terms of the same series. The aforementioned sizes need not relate only to the panel sizes to be produced (see figure) but may also relate to a sawing piece- or material size. The combination and exchangeability is identical to that of the kitchen elements. Due to the plan in the size system a standard itemization for the panel couplings both in the horizontal and the vertical sense can be arranged.

Other fields on which the series of elements according to my invention can be advantageously used are: containers, packings, cans and do-it-self shops. There, too, elements which are capable of being summed are usable and so loss of space is avoided, or storage space saved.

What I claim is:

1. A plurality of structural articles constructed to be physically connected together to form an overall larger structure, comprising:

at least one first structural article forming part of said plurality of structural articles;

each said first structural article being constructed to have at least one first predetermined relevant linear dimension;

at least one second structural article forming part of said plurality of structural articles;

each said second structural article being constructed to have at least one second predetermined relevant linear dimension;

said second predetermined relevant linear dimension of said second structural article being constructed to be equal to the product of a factor $(\frac{1}{2} + \frac{1}{2}\sqrt{5})$ multiplied by said first predetermined relevant linear dimension of said first structural article; and said first structural articles and said second structural articles being constructed so that any two or more of said structural articles may be physically connected to form said overall larger structure.

2. A plurality of structural articles according to claim 1, including:

at least one third structural article forming part of said plurality of structural articles;

each said third structural article being constructed to have at least one third predetermined relevant linear dimension;

said third predetermined relevant linear dimension of said third structural article being constructed to be equal to the product of a factor $(\frac{1}{2} + \frac{1}{2}\sqrt{5})$ multiplied by said second predetermined relevant linear dimension of said second structural article;

said third structural article being constructed and dimensioned such that when said third structural article is divided into two portions wherein one of such portions has dimensions of said second structural article, then the other of such portions has the dimensions of said first structural article; and said first, second and third structural articles being constructed and dimensioned so that one or more of any of said first, second and third structural articles may be physically connected to form said overall larger structure.

3. A plurality of structural articles according to claim 2, wherein:

each of said structural articles is in the form of a rectangular parallelepiped;

and each edge of each structural article has a respective length the value of which constitutes a term in a mathematical series;

each term in said mathematical series is the product of the preceding term by the factor $(\frac{1}{2} + \frac{1}{2}\sqrt{5})$; and at least two terms in said mathematical series are represented by said respective edge lengths.

4. A plurality of structural articles according to claim 6, wherein:

said structural articles are assembled in contiguous relationship so that the edges of all of said structural articles extend in respective ones of three predetermined mutually perpendicular directions.

5. A plurality of structural articles according to claim 2, wherein:

said plurality of structural articles each has one of its linear dimensions, herein referred to as the relevant dimension of such structural article, such that each of said relevant dimensions has a value constituting a term in the same mathematical series;

each term in said mathematical series being the product of the preceding term by the factor $(\frac{1}{2} + \frac{1}{2}\sqrt{5})$ and in which at least two terms of said series are represented by respective relevant dimensions of respective structural articles.

6. A plurality of structural articles according to claim 1, wherein:

each of said structural articles is in the form of a rectangular parallelepiped;

and each edge of each structural article has a respective length the value of which constitutes a term in a mathematical series;

each term in said mathematical series is the product of the preceding term by the factor $(\frac{1}{2} + \frac{1}{2}\sqrt{5})$; and at least two terms in said mathematical series are represented by said respective edge lengths.

7. A plurality of structural articles according to claim 6, wherein:

said structural articles are assembled in contiguous relationship so that the edges of all of said structural articles extend in respective ones of three predetermined mutually perpendicular directions.

8. A plurality of structural articles according to claim 1, wherein:

said plurality of structural articles are constructed to be physically connected together to form an overall larger structure which constitutes a kitchen interior;

the smallest relevant dimension is 5.4 centimeters; and the largest relevant dimension is 60.3 centimeters.

9. A plurality of structural articles according to claim 1, wherein:

said plurality of structural articles each has one of its linear dimensions, herein referred to as the relevant dimension of such structural article, such that each of said relevant dimensions has a value constituting a term in the same mathematical series;

each term in said mathematical series being the product of the preceding term by the factor $(\frac{1}{2} + \frac{1}{2}\sqrt{5})$ and in which at least two terms of said series are represented by respective relevant dimensions of respective structural articles.

10. A plurality of structural articles according to claim 8, wherein:

said plurality of structural articles each has one of its linear dimensions, herein referred to as the relevant dimension of such structural articles, such that each of said relevant dimensions has a value constituting a term in the same mathematical series;

each term in said mathematical series being the product of the preceding term by the factor $(\frac{1}{2} + \frac{1}{2}\sqrt{5})$ and in which at least two terms of said series are represented by respective relevant dimensions of respective structural articles.

* * * * *